US010293967B2

(12) United States Patent
Krämer et al.

(10) Patent No.: US 10,293,967 B2
(45) Date of Patent: May 21, 2019

(54) LABEL-FEEDING APPARATUS AND LABELLING APPARATUS

(71) Applicant: KHS GmbH, Dortmund (DE)

(72) Inventors: Klaus Krämer, Dortmund (DE); Lutz Deckert, Haltern am See (DE)

(73) Assignee: KHS GmbH, Dortmund (DE)

( * ) Notice: Subject to any disclaimer, the term of this patent is extended or adjusted under 35 U.S.C. 154(b) by 62 days.

(21) Appl. No.: 14/907,012

(22) PCT Filed: Jul. 3, 2014

(86) PCT No.: PCT/EP2014/064139
§ 371 (c)(1),
(2) Date: Jan. 22, 2016

(87) PCT Pub. No.: WO2015/010868
PCT Pub. Date: Jan. 29, 2015

(65) Prior Publication Data

US 2016/0167821 A1 Jun. 16, 2016

(30) Foreign Application Priority Data

Jul. 23, 2013 (DE) ..... 10 2013 107 841

(51) Int. Cl.
*B65C 9/18* (2006.01)
*B65C 9/22* (2006.01)

(52) U.S. Cl.
CPC ..... *B65C 9/1815* (2013.01); *B65C 9/2204* (2013.01)

(58) Field of Classification Search
CPC ..... B65C 9/1815; B65C 9/2204; Y10T 156/1052; Y10T 156/1062
See application file for complete search history.

(56) References Cited

U.S. PATENT DOCUMENTS

| | | | | |
|---|---|---|---|---|
| 5,624,520 | A | 4/1997 | Nedblake et al. | |
| 6,245,181 | B1 * | 6/2001 | Bright | B65C 3/00 156/215 |
| 2004/0007318 | A1 * | 1/2004 | Popp | A61F 13/15577 156/256 |
| 2009/0145558 | A1 * | 6/2009 | Saluz | B65C 9/1803 156/530 |
| 2011/0203431 | A1 * | 8/2011 | Cocozzella | A61F 13/15 83/23 |

FOREIGN PATENT DOCUMENTS

| | | |
|---|---|---|
| EP | 0 566 918 | 10/1993 |
| EP | 2 067 702 | 6/2009 |
| GB | 2 263 894 | 8/1993 |
| WO | WO2005/023654 | 3/2005 |

* cited by examiner

*Primary Examiner* — Mark A Osele
*Assistant Examiner* — Christopher C Caillouet
(74) *Attorney, Agent, or Firm* — Occhiuti & Rohlieck LLP

(57) ABSTRACT

An apparatus for labeling a container includes a label-strip feed that provides a label strip having individual labels to be separated by cutting. A first portion of the strip abuts a first transfer-device that causes slippage between the first portion and itself. A cutting device cuts a length of the strip to create a cut label. A portion of the length abuts a second transfer-portion prior to cutting. A holding force generated by this second transfer-device causes slippage between the portion of the length and the second transfer-device. After the cutting device creates the cut label, it transports the cut label. Either one of the two transfer-devices is a linearly-conveying transfer device.

19 Claims, 1 Drawing Sheet

LABEL-FEEDING APPARATUS AND LABELLING APPARATUS

RELATED APPLICATIONS

This is the national stage of international application PCT/EP2014/064139 filed on Jul. 3, 2014, which claims the benefit of the Jul. 23, 2013 priority date of German application DE 102013107841.9, the contents of which are herein incorporated by reference.

FIELD OF INVENTION

The invention relates to labeling packages, and in particular, to feeding labels.

BACKGROUND

A label strip is made of individual labels that have to be cut before being placed on a bottle. A label feeder usually has two transfer drums that cause the label strip to follow an S-shaped path under tension. Once the label strip has advanced by some pre-determined length, a cutting device cuts off the appropriate portion of the label strip to make a label.

A disadvantage of known label feeders is that the tension causes the label strip to stretch slightly. This makes it difficult to cut labels of uniform length. If these length discrepancies exceed a certain tolerance, unwanted effects arise in the application of glue on the labels or the application of the labels on the containers to be labeled. A further problem that arises is that after a label is cut from the label strip, the end from which it was cut, which is under tension snaps back and can remain hanging on the cutting device.

SUMMARY

An object of the invention is to provide a label-feeding apparatus that allows a defect-free label supply and that cuts labels such that the labels differ in length by no more than a pre-determined tolerance.

According to a first aspect, the invention relates to an apparatus for feeding labels to a container to be labeled. The apparatus comprises a label strip feed by means of which a continuous label strip is supplied, and a first transfer-device against which at least one sub-length of the label strip comes into abutment. The first transfer-device is designed to generate a slippage between this sub-length of the label strip and the first transfer-device. The apparatus also includes a cutting device to cut a sub-length of the label strip, this generating a label. Before cutting, a partial section of the sub-length of the label strip to be cut comes into abutment with a second transfer-device that exerts a holding or fixing force on this partial section to generate a slippage between this partial section of the label strip and the second transfer-device. After the label is cut, the second transfer-device moves it along. In this apparatus, either the first or second transfer-device, or both, is a linearly conveying transfer device.

The invention is based on the recognition that the rise in tensile forces that are exerted on the free end of the label strip by the holding and fixing forces exerted by the second transfer-device and by the transfer devices moved through under the label strip with slippage can be reduced by reducing a wrap-around angle. This wrap-around angle is the angle range along which a sub-length of the label strip lies on a circumference of a drum-like or roller-like transfer device.

The invention relies at least in part on the use of a linearly conveying transfer device. Such a transfer device is one on which the label strip is conveyed in a straight line. By using such a device, it is possible to reduce the wrap-around angle. This minimizes or reduces the rise of the forces acting on the label strip. As a result, it becomes possible to avoid undesirable length variations in the labels cut from the label strip.

In a preferred embodiment, the first and/or second transfer-device is a linearly conveying transfer device at least in the transfer region in which the transfer of a cut label from the first transfer-device to the second transfer-device takes place. Before a label is cut, the free end of the label strip is held under tension by the holding and fixing forces exerted at the first and/or second transfer-devices and by the slippage. The label strip lies by a first sub-region of the label subsequently to be cut against the first transfer-device and by another sub-region of the label subsequently to be cut against the second transfer-device. Using a linearly conveying transfer device in the transfer region of either the first or second transfer-devices reduces the diversion inherent in the use of drum-like or roller-like transfer devices, in particular the S-shaped diversion of the label strip in the transfer region. This tends to minimize the increase in the tensile forces when the free end of the label strip is moved past onto the second transfer-device.

In a preferred embodiment, the first and/or second transfer-device includes a belt conveyor. Among these embodiments are those that have a loop-shaped conveyor belt routed under tension over at least one pair of carrier spools, which are preferably rollers and preferably driven continuously. Between the carrier spools are straight-line conveyor belt regions, or straightaways, the linear conveying of the label strip can take place.

The first and/or second transfer-device preferably generates the holding and fixing forces by suction of a sub-length of the label strip or of the cut label. To facilitate such generation, the transfer devices preferably have openings that can be exposed to negative pressure so that, when the label strip is laid against these openings, a suction and thus fixing of the label strip occurs. By fixing the label strip against the transfer devices, it becomes possible to cause a slippage between the transfer device and the label strip. This slippage results in a tensile force on the label strip. This tensile force ultimately places a region of the free end at which the individual label is cut from the label strip under tension.

In a preferred embodiment, the first transfer-device has a transport speed that is greater than a feed speed at which a label-strip feed feeds the label strip. Because the transport speed of the first transfer-device is higher than that of the label-strip feed, slippage occurs between the first transfer-device and the label strip section that lies opposite the first transfer-device. This slippage holds the label strip under tension between the label strip feed and the first transfer-device.

In a preferred embodiment, the second transfer-device has a transport speed that is the same as or greater than the transport speed of the first transfer-device. In this way, the label strip is likewise held under tension between the first transfer-device and the second transfer-device, resulting in slippage between the second transfer-device and the label strip. In particular, the transport speed of the second transfer-device is greater than the feed speed of the label-strip feed so that, after the cutting, the cut label is moved on at a higher speed than the free end of the label strip. This creates a time window during which the label can be applied to the container to be labeled.

The first transfer-device is preferably a transfer drum that rotates about an axis of rotation and against which the label strip lies along a defined angle range of the drum's circumference. This partial encirclement of the first transfer-device by the label strip diverts the label strip's direction of movement by a defined angle.

In a preferred embodiment, the first transfer-device is a component of a cutting device and/or the first transfer-device is made with a cutting device to cut the label from the continuous label strip. In some embodiments, the first transfer-device includes a cutting drum. By means of this cutting device, a desired length of the label strip can be cut in the region of the free end, thus creating a cut label that can be applied on a container arises. After cutting, the cut label is preferably transported further by the second transfer-device and fed to the container to be labeled.

In some embodiments, a glue-applicator is provided at the region of the second transfer-device. The glue-applicator applies a coat of glue to the back of the label. In particular, the glue-application apparatus sprays or sprinkles the label with glue.

According to a further aspect, the invention relates to a labeling apparatus for labeling containers, with the labeling apparatus including a label feed as described.

In another aspect, the invention relates to a method for feeding labels to a container to be labeled with a label strip being supplied with individual labels to be divided individually by cutting, with at least one sub-length of the label strip coming into abutment against a first transfer-device by means of which the sub-length of the label strip is transported on under tension with slippage, with a sub-length of the label strip being cut by a cutting device to create a label, with at least one second transfer-device, against which at least one partial section of the sub-length of the label strip to be cut comes into abutment before the cutting, generating both holding forces on this partial section of the label strip and a slippage between this partial section of the label strip and the second transfer-device, and after cutting, with the second transfer-device effecting the further transport of the cut label, and with a sub-length of the label strip being conveyed in a linear manner by the first and/or second transfer-device.

In one practice of the method, a partial section of the label strip is conveyed in a linear manner at least in the transfer region at which the transfer of the cut label from the first transfer-device to the second transfer-device takes place.

In another practice, at least one partial section of the label strip is held by suction at the first and/or second transfer-device.

Another practice includes rotating a transfer drum of the first transfer-device.

Another practice of the invention is one in which the continuous label strip is preferably cut in the region of the first transfer-device, to thereby cut off individual labels.

In another aspect, the invention features an apparatus for labeling a container includes a label-strip feed that provides a label strip having individual labels that are to be separated by cutting. A first portion of the label strip comes into abutment with a first transfer-device that causes slippage between the first portion and itself. A cutting device is configured to cut a length of the label strip, thus creating a cut label. A portion of the length comes into abutment with a second transfer-device prior to cutting. This second transfer-device generates a holding force on the portion of the length so as to cause slippage between the portion of the length and the second transfer-device. After the cutting device cuts to create the cut label, the second transfer-device transports the cut label. At least one of the first and second transfer-devices is a linearly-conveying transfer device.

In some embodiments, either the first or second transfer device includes a transfer region at which transfer of the cut label takes place. The linearly-conveying transfer device includes this transfer region.

Yet other embodiments include a transfer belt. This transfer belt is either part of the first transfer-device or part of the second transfer-device.

Also among the embodiments are those in which one of the first and second transfer-devices generates a holding force to hold a substrate that abuts it. Among these embodiments are those in which the substrate is a portion of the label strip and those in which it is the cut label.

In some embodiments, the first transfer-device operates at a first transport-speed and the label-strip feed feeds label strip at a feed speed that is less than the first transport-speed. Among these embodiments are those in which the second transfer-device operates at a second transport speed that is greater than or equal to the first transport-speed.

Some embodiments include a transfer drum driven to rotate about an axis of rotation. This transfer drum can be either part of the first transfer-device or part of the second transfer-device.

Other embodiments feature a glue applicator disposed at the second transfer-device. In some of these embodiments, the second transfer-device applies cut labels to containers that are being carried by a rotor.

Embodiments include those in which the first transfer-device includes the linearly-conveying transfer device and those in which it is the second transfer-device that includes the linearly-conveying transfer device.

In another aspect, the invention features a method for feeding labels to a container to be labeled. Such a method includes providing a label strip having individual labels that are to be separated from the label strip by cutting, causing a first portion of the label strip to abut a first transfer-device, exerting a holding force on the first portion, using the first transfer-device, transporting the first portion under tension, while transporting the first portion under tension, causing slippage of the first portion, causing a second portion of the label strip to abut a second transfer-device, exerting a holding force on the second portion, causing slippage of the second portion relative to the second transfer-device, using the second transfer-device, transporting the second portion under tension, cutting a length of the label strip to separate an individual label, thereby forming a cut label, causing the second transfer-device to further transport the cut label, wherein at least one of transporting the first portion and transporting the second portion includes transporting linearly.

In some practices, transporting linearly includes transporting linearly in a transfer region at which a transfer of the cut label from the first transfer-device to the second transfer-device takes place.

In other practices, exertion of a holding force, whether on the second portion or on the first portion, includes exerting a suction force.

Other practices are those in which transporting a portion, whether it is the first or second portion, includes transporting it on a transfer drum that is driven to rotate about an axis of rotation.

Yet other practices include the further step of cutting the label strip at the first-transfer device.

As used herein, "transfer spool" and "transfer drum" refer to a transfer device that has a circular cross-section and that rotates about an axis of rotation.

As used herein, the expressions "substantially" and "approximately" mean deviations from exact values by ±10%, and preferably by ±5%, and/or deviations that are not significant for functioning.

The term "and/or" is intended to be a non-exclusive "or" with the result that to say "A and/or B" means that A is true and B is false, B is true and A is false, or both A and B are true.

Further developments, benefits, and possible applications of the invention arise also from the following description, which includes examples of particular embodiments. All characteristics described and/or illustrated individually or in any combination are the subject of the invention, regardless of their inclusion in the claims or reference to them. The content of the claims is also an integral part of the description.

These and other features and advantages of the invention will be apparent from the following detailed description and the accompanying figures, in which

DETAILED DESCRIPTION

Figure 1:
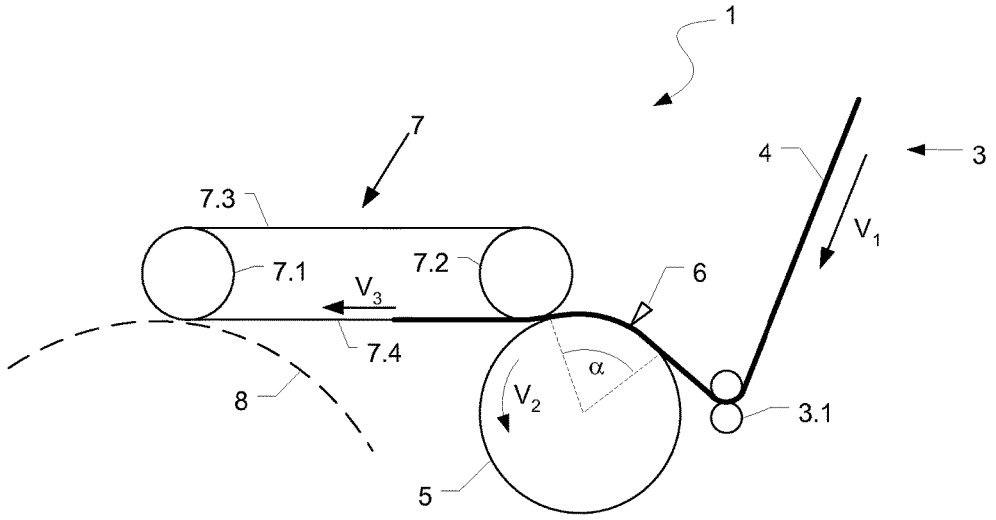
FIG. 1 shows a top view of a first embodiment of a feeding apparatus.

FIG. 1 shows a label-feeder 1 receiving a continuous label strip 4 that carries a series of individually separable labels. These labels are either contiguous, so that one immediately follows another, or they are separated by a predetermined distance. A spool or similar storage device provides the label strip 4 to the label-feeder 1.

A label-strip feed 3 engages the label strip 4 with a label-strip drive 3.1. In the illustrated embodiment, the label-strip drive 3.1 comprises a pair of spools driven in opposite directions through which the label strip 4 is routed.

Following the label-strip drive 3.1, the label strip 4 passes over a first transfer-device 5. In the illustrated example, the first transfer-device 5 is a transfer spool or transfer drum that rotates counter-clockwise. A first portion of the label strip 4 abuts a circumference of the first transfer-device 5 and wraps around a portion of its surface. A wrap-around angle $\alpha$ identifies the extent of this portion.

The label strip 4 continues past the first transfer-device 5 and engages a second transfer-device 7. In the illustrated embodiment, the second transfer-device 7 is a transfer belt that circulates under tension around a loop. First and second carrier-spools 7.1, 7.2 define the ends of the loop. Between the first and carrier-spools 7.1, 7.2 are first and second straightaways 7.3, 7.4. The overall apparatus thus includes one linear transporter, namely the second transfer-device 7, and one rotary transporter, namely the first transfer-device 5.

During operation, a first portion of the label strip 4 lies on the first transfer-device 5, a second portion of the label strip 4 lies on the second straightaway 7.4, a third portion of the label strip 4 lies on the first carrier spool 7.1, a fourth portion of the label strip 4 lies on the first straightaway 7.3, and a fifth portion of the label strip 4 lies on the second carrier spool 7.2.

Using a vacuum source or negative-pressure source that sucks air through openings, the second transfer-device 7 applies suction to the portion of the label strip 4 that abuts it. This results in a pressure force that fixes the label strip 4 onto the transfer device 7. Other types of fixing are feasible. An example is fixing by electrostatic charging.

In some embodiments, the first transfer-device 5 is what fixes the label strip 4. In others, both the first and second transfer-devices 5, 7 fix the label strip 4.

The label-strip drive 3.1 transports the label strip 4 at a first speed V1. The first transfer-device 5 rotates at a rate sufficient to transport the label strip 4 at a second speed V2, and the third transfer device 7 rotates at a rate sufficient to transport the label strip at a third speed V3. The first speed V1 is less than the second and third speeds V2, V3. Preferably, the third speed V3 is greater than or equal to the second speed V2.

The label-strip feed 3 has a retaining effect that ensures that the label strip 4 is transported over its entire length only at the first speed V1. As a result, the label-strip feed 3 feeds the label strip 4 to the first and second transfer-devices 5, 7 at a feed speed that is less than that of their respective transport speeds. This results in slippage between the first transfer-device 5 and first portion of the label strip 4. It also results in slippage between the second transfer-device 7 and the second and fourth portions of the label strip 4. As a result, the first and second transfer-devices 5, 7 place the label strip 4 under tension.

At the first transfer-device 5 is a cutting device 6 that can be used to cut a section of the label strip 4 to form a label to be applied on a container 2. Immediately before being cut, the first portion of the label strip 4 lies under tension against the first transfer-device 5 and the remaining portions lies under tension against the second transfer-device 7. The cutting device 6 releases this tension when it cuts the label strip 4. As a result, the first and second transfer-devices 5, 7 transport the cut label onwards, preferably without slippage, at a transport speed that is greater than the feed speed of the label strip feed 3.

In one embodiment, shown in FIG. 1, the first and second transfer-devices 5, 7 transport the cut label to a third transfer device 8. In an alternative embodiment, the second transfer-device 7 applies the cut label to a container 2 carried by a labeling conveyor 9 conveying the containers 2 to be labeled, as shown in FIG. 2.

The use of at last one linearly conveying transfer device 7 ensures a lower tensile load on the label strip 4. This reduced tensile load leads to the label strip 4 experiencing reduced expansion. This, in turn, helps avoid length discrepancies in the cut labels as a result of the label strip 4 expanding under tension.

Figure 2:
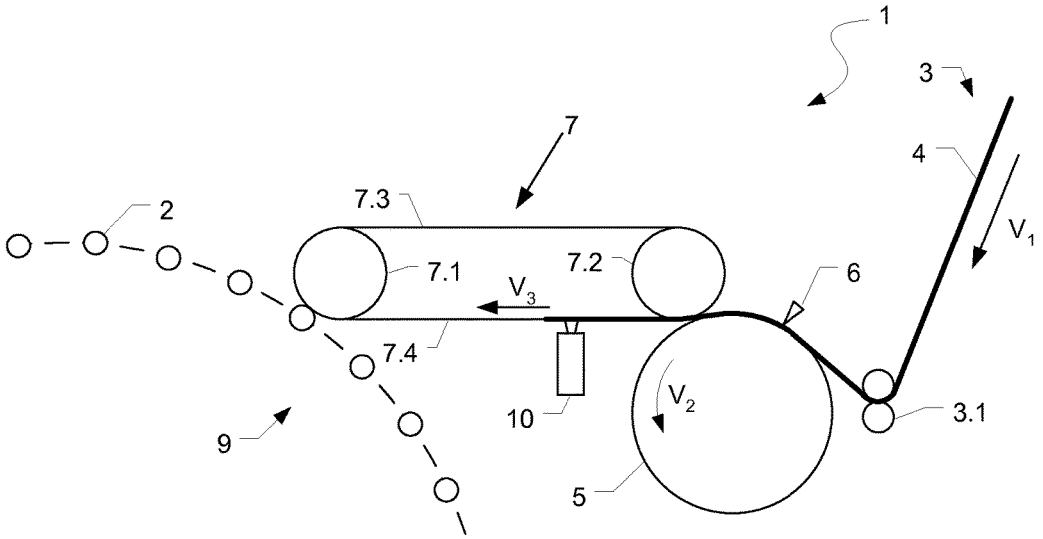
FIG. 2 shows a top view of a second embodiment of a feeding apparatus.

In the embodiment shown in FIG. 2, the second transfer-device 7 feeds cut labels directly to the container 2 to be labeled. In this embodiment, a glue applicator 10 applies glue to the backs of labels as they proceed along the second straightaway 7.4. In some embodiments, the glue applicator 10 sprays glue onto the backs of the labels.

The label feeder 1 features one transfer drum and one linearly conveying transfer device. However, the order of these elements does not matter. In the embodiments described thus far, it was the first transfer-device 5 that was a transfer drum and the second transfer-device 7 was a linearly conveying transfer device. Some embodiments reverse this configuration. In these embodiments, the first transfer-device 5 is the linearly conveying transfer device and the second transfer-device 7 is the transfer drum.

Having described the invention, and a preferred embodiment thereof, what is claimed as new, and secured by Letters Patent is:

1. An apparatus for labeling a container, said apparatus comprising a label-strip feed, a first transfer-device comprising a transfer drum, and a second transfer-device comprising a linearly-conveying transfer device, wherein said transfer drum comprises a cutter, wherein said label-strip feed provides a label strip that comprises individual labels to be separated by having said cutter cut said label strip against said transfer drum, wherein, prior to being cut by said cutter against said transfer drum, a first portion of said label strip comes into abutment with said transfer drum along a defined angular extent of a circumference of said transfer drum, and a second portion of said label strip comes into abutment with said linearly-conveying transfer device, wherein, as a result of a holding force generated by said linearly-conveying transfer device on said second portion, slippage occurs between said first portion and said transfer drum, wherein, after said cutter has cut to create said cut label, said linearly-conveying transfer device transports said cut label, wherein said transfer drum is driven to rotate about an axis of rotation, and wherein said label strip approaches said transfer drum along a movement direction and abuts said defined angular extent such that said drum deflects said label strip by a defined angle from said movement direction, said apparatus further comprising a third transfer-device, wherein said first and second transfer-devices transport said cut label to said third transfer-device.

2. The apparatus of claim 1, wherein said label-strip feed comprises a label-strip drive.

3. The apparatus of claim 1, wherein said label-strip feed comprises a pair of spools driven in opposite directions through which said label strip is routed.

4. The apparatus of claim 1, wherein said transfer drum is configured to generate a holding force to hold a portion of said label strip.

5. The apparatus of claim 1, wherein said transfer drum operates at a first transport-speed, wherein said label-strip feed feeds said label strip to said transfer drum at a feed speed, and wherein said first transport-speed exceeds said feed speed.

6. The apparatus of claim 1, wherein said linearly-conveying transfer device, said transfer drum, and said label-strip feed are driven at first, second, and third speeds, wherein said first speed is greater than said second speed and said second speed is greater than said first speed.

7. The apparatus of claim 1, further comprising a rotor that carries containers that are to be labeled, wherein said linearly-conveying transfer device is positioned to apply cut labels, to which glue has been applied, to said containers.

8. The apparatus of claim 1, wherein said transfer drum and said linearly-conveying transfer device both exert a holding force on said label strip.

9. The apparatus of claim 1, wherein said movement direction is along a velocity vector that has a component that leads towards said linearly-conveying transfer device.

10. The apparatus of claim 1, wherein said defined angular extent of said circumference of said transfer drum is less than 180 degrees.

11. The apparatus of claim 1, wherein said transfer drum is a cutting drum.

12. The apparatus of claim 1, wherein said linearly-conveying transfer device comprises a glue applicator.

13. The apparatus of claim 1, wherein said defined angle from said movement direction is an obtuse angle.

14. The apparatus of claim 1, wherein said defined angular extent of said circumference of said transfer drum is less than ninety degrees.

15. The apparatus of claim 1, wherein immediately before being cut, said first portion of said label strip lies under tension against said transfer drum and said second portion lies under tension against said linearly-conveying transfer device, wherein said cutter releases said tension upon cutting said label strip, and wherein said transfer drum and said linearly-conveying transfer device transport said cut label onward at a transport speed that exceeds a feed speed of said label-strip feed.

16. A method comprising causing a label strip to slip relative to a first transfer-device's transfer drum and cutting said label against said transfer drum, said method comprising causing said transfer drum to rotate about an axis of rotation, causing said label strip to approach said transfer drum along a movement direction, said label strip comprising individual labels that are to be separated by cutting against a circumference of said transfer drum, abutting a first portion of said label against a defined angular extent of said circumference of said transfer drum such that said transfer drum deflects said label strip by a defined angle from said movement direction, abutting a second portion of said label strip against a second transfer-device's linearly-conveying transfer device, causing said linearly-conveying transfer device to generate a holding force on said second portion, thereby promoting slippage between said first portion and said transfer drum, cutting said label against said circumference of said transfer drum, after cutting, causing said first and second transfer-devices transfer device to transport said cut label to a third transfer-device.

17. The method of claim 16, wherein causing said linearly-conveying transfer device to generate a holding force comprises causing said linearly-conveying transfer device to exert an electrostatic force.

18. The method of claim 16, further comprising selecting said defined angular extent to be small enough to promote said slippage.

19. An apparatus for feeding labels to a container that is to be labeled, said apparatus comprising a label strip feeding means by means of which a label strip is supplied, said label strip having a multiplicity of individual labels that are to be separated by cutting, said apparatus further comprising a first transfer device against which at least one sub-length of said label strip comes into abutment, wherein said first transfer device is designed for creating slippage between said sub-length of said label strip and said first transfer device, at least one cutting device for severing a sub-length of said label strip in order to produce a label, at least one second transfer device against which at least one portion of said sub-length of said label strip that is to be severed comes into abutment prior to said severing operation, wherein said second transfer device is designed for applying retaining forces to said portion of said label strip for creating slippage between said portion of said label strip and said second transfer device and, following said severing operation, for receiving said severed label and transporting it onwards, and wherein said second transfer device is configured at least in sections as a linear conveying transfer device, wherein said first transfer device is a transfer drum driven such as to rotate about an axis of rotation and against which said label strip is in abutment in sections on a circumferential side in a defined angle range such that said label strip is deflected at said first transfer device by a defined angle value in its direction of movement, and wherein said first transfer device is a constituent part of a cutting device and/or is configured with a cutting device for severing said label from said ongoing label strip, wherein said first and second transfer-devices transport said cut label to a third transfer-device.

* * * * *